United States Patent [19]

Takeyama et al.

[11] 4,405,123

[45] Sep. 20, 1983

[54] AUTOMATIC PAPER SHEET FEEDING DEVICE FOR COPYING MACHINE

[75] Inventors: Kokichi Takeyama; Kiyoshi Sugawara; Yasuyuki Fukagawa, all of Kanagawa, Japan

[73] Assignee: Fuji Xerox Co., Ltd., Tokyo, Japan

[21] Appl. No.: 313,704

[22] Filed: Oct. 21, 1981

[30] Foreign Application Priority Data

Oct. 21, 1980 [JP] Japan ..... 55-146248

[51] Int. Cl.[3] ..... B65H 3/30

[52] U.S. Cl. ..... 271/22; 271/24; 271/127; 271/160; 271/164

[58] Field of Search ..... 271/22, 24, 25, 117, 271/126, 127, 160, 162, 164

[56] References Cited

U.S. PATENT DOCUMENTS 4,219,192 8/1980 Burke ..... 271/160

4,372,547 2/1983 Yanagawa ..... 271/160 X

*Primary Examiner*—Richard A. Schacher

*Attorney, Agent, or Firm*—Sughrue, Mion, Zinn, Macpeak, and Seas

[57] ABSTRACT

An automatic paper sheet feeding device for a copying machine has a cassette with a base plate made of magnetic material which is secured by a magnet to a bottom plate of the cassette against a biasing force of a spring. The device has a cam member which enters a slot in the cassette after the cassette has been inserted into the device. This raises the base plate upwardly which releases the base plate from the magnetic holding force allowing the base plate to rotatingly move upwardly and contact a feeding roll due to the force of the spring.

4 Claims, 2 Drawing Figures

AUTOMATIC PAPER SHEET FEEDING DEVICE FOR COPYING MACHINE

BACKGROUND OF THE INVENTION

The present invention relates to an automatic paper sheet feeding device for use with a copying machine.

The conventional automatic paper sheet feeding device for a copying machine generally has a structure such as shown in FIG. 1, in which paper sheets b housed in a cassette a is fed by a feed roll d one by one to a feeding passage e connected to the copying machine (not shown) with the aid of a snubber c. The paper sheets b in the cassette a are supported by a base plate f biased upwardly by a spring g and the uppermost paper sheet is urged against the feed roll d.

Thus, at a time when the cassette a is to be inserted into the copying machine, the level of the front end of the uppermost one of the paper sheets b housed in the cassette a is higher than the lowest end of the feeding roll d.

Therefore, the front edges of some of the paper sheets b hit the roll d every time when the cassette a is inserted into the copying machine causing those edge portions to be deformed, resulting in a malfunction of the subsequent feeding operation.

SUMMARY OF THE INVENTION

An object of the present invention is to improve the cassette structure to be used with an automatic paper sheet feeding device for a copying machine so that the that the edges of the paper sheets in the cassette do not hit the feeding roll at the insertion of the cassette into the automatic paper sheet feeding device.

The above object of the present invention can be achieved by constituting the cassette such that a base plate on which a stack of paper sheets are mounted can be held in parallel with a bottom plate of the cassette against a spring force until the cassette is inserted into the automatic paper sheet feeding device and the front edges of the paper sheets pass the roll.

DETAILED DESCRIPTION OF THE EMBODIMENT

Figure 1:
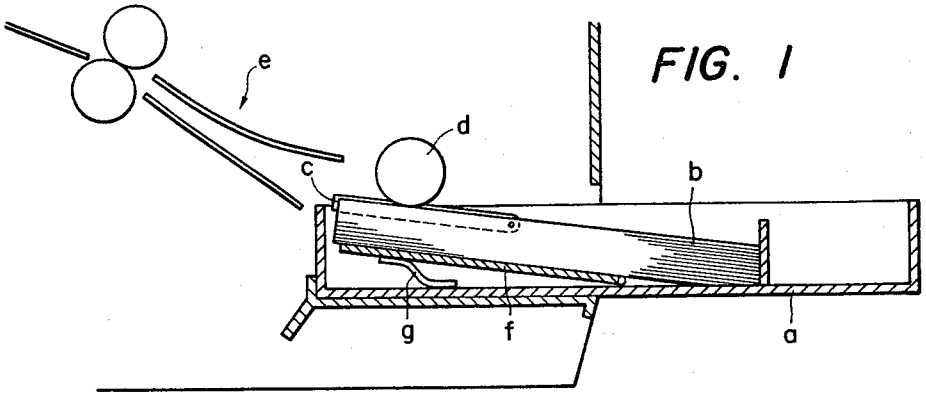
FIG. 1 is a cross sectional view of the conventional paper sheet cassette.
Figure 2:
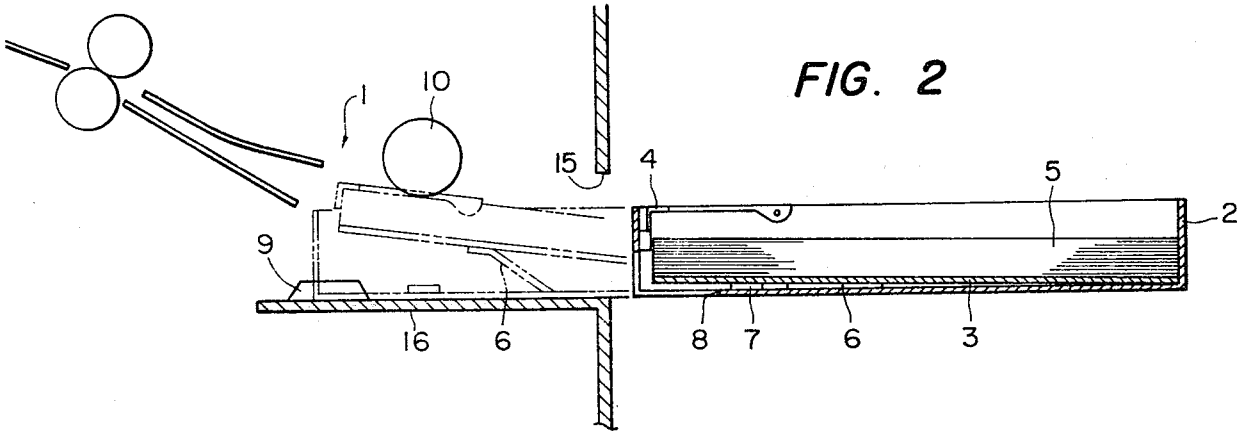
FIG. 2 is a similar view of the paper sheet cassette according to the present invention.

FIG. 2 shows an embodiment of the present invention in cross section. An automatic paper sheet feeding device 1 has a guide opening 15 in a side wall thereof and a guide 16 for receiving and guiding a cassette 2 into an operating position within the feeding device 1. The feeding device 1 has a feed roll 10 at a position just above the operating position of the cassette 2 and a cam member 9 having tapered sides is fixedly disposed on the guide 16 of the feeding device 1.

In the cassette 2, a base plate 3 is disposed. The base plate 3 is made of magnetic material. The cassette 2 further includes a snubber 4. A stack of paper sheets 5 are mounted on the base plate 3 and front corners of the stack are held by the snubber 4. A spring 6 is also provided between the base plate 3 and a bottom plate of the cassette 2 to bias the base plate 6 rotatingly upwardly. The cassette 2 is provided with a magnet 7 fixedly secured to the bottom plate thereof.

The magnet 7 functions to hold the base plate 3 in parallel with the bottom plate of the cassette 2 against the force of the spring 6 in the non-use state of the cassette.

The cassette 2 is formed with a slot 8 in the front portion thereof, the function of which is to be described later.

With the structure mentioned above, the base plate 3 is attracted by the magnet 7 when depressed and the attracted state is held by the magnetic force. Therefore when a stack of paper sheets is mounted on the base plate 3, the front edge portions therefore do not extend beyond the top of the cassette 2.

In use, when cassette 2 is inserted through the guide opening 15 into the automatic paper sheet feeding device 1 along the guide 16, the base plate 3 of the cassette is held parallel to the bottom plate by the magnet 7. It should be noted that the position of the cam member 9 in the automatic paper sheet feeding device 1 corresponds to the position of the slot 8 of the cassette 2 when disposed in place within the device 1. That is, when the cassette 2 is inserted into the feeding device 1, the cam member 9 enters into the slot 8 of the cassette 2 and impinges with the front edge of the base plate 3. Since the end of the cam member 9 is tapered, the base plate 3 rides on the cam member 9 against the magnetic attractive force due to the magnet 7 with the advancing movement of the cassette 2. Therefore, the base plate 3 is rotatively moved upwardly by the action of the spring 6 up to a predetermined level in which the uppermost paper sheet 5 contacts with the feeding roll 10.

As mentioned before, since the base plate 3 is held in parallel with the bottom plate of the cassette 2 by the provision of the magnet 7, the insertion thereof into the automatic paper sheet feeding device 1 is facilitated. Since the base plate 3 is automatically moved upwardly by the very simple combination of the cam member 9 disposed in the feeding device 1 and the slot 8 formed in the cassette 2 at the very end of the cassette insertion stroke, the contact of the paper sheet with the feed roll 10 is ensured.

What is claimed is:

1. An automatic paper sheet feeding device for a copying machine having a stack of paper sheets mounted on a base plate in a cassette, the plate being biased rotatively upwardly by a spring so that an uppermost paper sheet of the stack is in contact with a feeding roll to feed the paper sheets to the copying machine one by one with a rotation of the feeding roll, comprising:
   - a magnet fixedly secured on a bottom surface of the cassette, the magnet holding the base plate in parallel with the bottom surface of the cassette against the spring force when the base plate is close to the magnet;
   - a slot formed in a front portion of the cassette; and
   - a cam member, the cam member being able to enter into the slot when the cassette is inserted into the automatic paper sheet feeding device and being engageable with a front edge of the base plate to release the base plate from the magnetic holding force of the magnet to allow the base plate to rotatingly move upwardly by the force of the spring.

2. The device according to claim 1 further comprising a snubber for holding front corners of the stack.

3. The device according to claim 1 wherein the cam member is positioned inside a guide opening, the cassette being insertable into the device through the guide opening.

4. The device according to claim 3 wherein said base plate is made of magnetic material.

* * * * *